US010179466B2

(12) United States Patent
Leu et al.

(10) Patent No.: US 10,179,466 B2
(45) Date of Patent: Jan. 15, 2019

(54) INKJET PRODUCT CODING PRINTING SYSTEM AND METHOD

(71) Applicants: Chih-Jen Leu, East Brunswick, NJ (US); Amgad Awad, Parlin, NJ (US)

(72) Inventors: Chih-Jen Leu, East Brunswick, NJ (US); Amgad Awad, Parlin, NJ (US)

(73) Assignee: A & L AUTOMATION CORPORATION, East Brunswick, NJ (US)

( * ) Notice: Subject to any disclaimer, the term of this patent is extended or adjusted under 35 U.S.C. 154(b) by 0 days.

(21) Appl. No.: 15/687,521

(22) Filed: Aug. 27, 2017

(65) Prior Publication Data

US 2018/0056683 A1 Mar. 1, 2018

Related U.S. Application Data

(60) Provisional application No. 62/380,418, filed on Aug. 27, 2016.

(51) Int. Cl.

| | |
|---|---|
| ***B41J 25/00*** | (2006.01) |
| ***B41J 2/01*** | (2006.01) |
| ***B41J 2/165*** | (2006.01) |
| ***B41J 25/304*** | (2006.01) |

(52) U.S. Cl.

CPC ..... *B41J 25/006* (2013.01); *B41J 2/01* (2013.01); *B41J 2/1652* (2013.01); *B41J 2/16526* (2013.01); *B41J 2/16532* (2013.01); *B41J 25/304* (2013.01)

(58) Field of Classification Search

CPC . B41J 25/006; B41J 2/01; B41J 2/1652; B41J 2/16526; B41J 2/16532

See application file for complete search history.

(56) References Cited

U.S. PATENT DOCUMENTS 7,146,236 B2 * 12/2006 Silverbrook ..... B22F 3/008 700/118
2008/0007585 A1 * 1/2008 Ueda ..... B41J 2/16526 347/15

* cited by examiner

*Primary Examiner* — Lamson Nguyen
(74) *Attorney, Agent, or Firm* — Changi Wu; Law Office of Changi Wu

(57) ABSTRACT

An inkjet product coding printing system comprises a plurality of printing objects comprising a travel direction and a printing surface arranged vertically; at least one inkjet printer head, wherein the inkjet printer head further comprises a plurality of ink nozzles facing the printing surface of the plurality of printing objects, wherein the plurality of ink nozzles is arranged in a plurality of rows configured along the travel direction of the plurality of printing objects, wherein the inkjet printer head can move up and down vertically, wherein the inkjet printer head moves orthogonally to the travel direction of the plurality of printing objects when the inkjet printer head ejects an ink; a motion unit connected with the inkjet printer head; and at least one control system controlling the motion unit and the inkjet printer head, and a method of printing product coding information by the inkjet product coding printing system.

17 Claims, 10 Drawing Sheets

INKJET PRODUCT CODING PRINTING SYSTEM AND METHOD

CROSS-REFERENCE RELATED TO RELATED APPLICATIONS

This application claims the benefit and priority of U.S. Provisional Application No. 62/380,418, filed Aug. 27, 2016.

BACKGROUND

Commercial products need product label to provide product information for customers' purchase decision and to meet regulatory requirements. Product information consists of static information, such as ingredients, and dynamic information, such as the production date, times, expiration date, control number, and lot number. The static information can be preprinted on product label in print shop, but dynamic information will need to be printed in a real-time basis according with the time of production and the sequence of the production. This real-time printing is an information coding printing system. Most of the product label coding systems are installed in the production line to work with product packing system. The printed codes on the label must have high clarity for legibility under a high speed printing process.

In the current market, there are two major types of label coding printing systems: contact type or noncontact type. Thermal transfer ribbon printing represents one kind of contact type printing system. A thermal transfer ribbon printing system utilizes a ribbon coated with adhesive printing substrate. The printer head with printing pints presses the ribbon to contact with label or printing object, heats the printing pints to melt adhesive printing substrate onto the label or the surface of the printing object, and allows the coding information to be adhered on the label or the surface of a printing object. The disadvantages of the thermal transfer ribbon systems include the slow speed of the printing process, the waste of unused portion of the thermal ribbon, the size of thermal printer head to cover printing area, and the complex mechanical structures causing the downgrade of the thermal printer head.

Noncontact type printing system includes laser printer and inkjet printer. Laser printing system utilizes a label containing a top coating and a colorant base coat. The laser burns out the top coat and reveal the colorant to present the coding information. The disadvantage of the laser printing system is the high cost of the system, the complexity to reconfigure the production line to fit the laser printing system, and the hazardous gas causing environmental concerns. The other noncontact type printing system is inkjet printing system. The inkjet printing system is smaller and simpler than thermal transfer ribbon system or laser printing system. It utilizes a replaceable printing cartridge that have rows of ink nozzles to inject printing substrate onto a label or the surface of a print object. Inkjet printing system has shorter printing time than thermal transfer ribbon, no wear of inkjet printer head as thermal transfer ribbon, and no waste of unused material like thermal ribbon. It is also a better system than the laser printing system for its simplicity, lower cost, and no hazardous gas.

However, the inkjet printing systems available in the current market and industry have several issues. Due to the technical obstacle, the current printer head and the printing objects are arranged to move horizontally. The printer head or the material/label moves horizontally. The direction of the rows of the ink nozzles of the inkjet printing cartridge is perpendicular to the travel direction of the label or the printing object, and the ink nozzles inject ink onto the label or the printing object while the label or the printing object is moving. The ink nozzles of the inkjet printer inject ink in accordance with a constant traveling speed of the label or the printing object passing under the ink nozzles. However, it is hard to control the traveling speed of the label or printing object on a production line. The factors affecting the control of traveling speed may include but not limited to the material of label, the thickness of label, the temperature, the humidity, and size of the label or printing material.

Also, the stationary location of the inkjet printer is hard to adjust in accordance with different size and location of the printing object, such a small can or a large bottle. Currently, it needs to dismount the inkjet printer, adjust its location, mount the inkjet printer, and adjust the printer again. If the location is not right, the adjustment process will need to be repeated.

Another common issue to inkjet printer is that the ink nozzles will have some printing ink buildup around the ink nozzles. When inkjet printer is not working, the buildup of the ink will be dried out and clog the ink nozzles. It needs an ink cleaning or ink purge system to clean the ink nozzle regularly. Current industrial application of the cleaning method is by manual clean, which increases the system downtime and does not a consistent clean result.

BRIEF SUMMARY

This Brief Summary is not intended to identify key or essential aspects of the claimed invention. This Brief Summary is similarly not intended for use as an aid in determining the scope of the claims. The current invention overcomes the aforementioned issues of current inkjet printer.

The current invention is directed to an inkjet product coding printing system comprising (a) a plurality of printing objects, wherein the plurality of printing objects further comprises a travel direction, wherein the plurality of printing objects further comprises a printing surface arranged vertically; (b) at least one inkjet printer head, wherein the inkjet printer head further comprises a plurality of ink nozzles facing the printing surface of the plurality of printing objects, wherein the plurality of ink nozzles is arranged in a plurality of rows configured along the travel direction of the plurality of printing objects, wherein the inkjet printer head can move up and down vertically, wherein the inkjet printer head moves orthogonally to the travel direction of the plurality of printing objects when the inkjet printer head ejects an ink; (c) a motion unit connected with the inkjet printer head; and (d) at least one control system controlling the motion unit and the inkjet printer head. The current invention is also directed to a method of printing product coding information on a plurality of printing objects, comprising the steps of: (a) moving one of the plurality of printing objects with a vertically arranged printing surface in a travel direction; (b) providing an inkjet product coding printing system, where the inkjet product coding printing system further comprises at least one inkjet printer head, wherein the inkjet printer head further comprises a plurality of ink nozzles facing the printing surface of the plurality of printing objects, wherein the plurality of ink nozzles is arranged in a plurality of rows configured along the travel direction of the plurality of printing objects, wherein the inkjet printer head can move up and down vertically; a motion unit connected with the inkjet printer head; and at least one control system controlling the motion unit and the inkjet printer head; (c) providing one of the plurality of printing objects relatively under the inkjet printer head; (d) moving the inkjet printer head orthogonally across the traveling direction of the plurality of printing objects; and (e) injecting an ink from the inkjet printer head on one of the plurality of printing objects at a same time as moving the inkjet printer head.

BRIEF DESCRIPTION OF THE DRAWINGS

It should be understood that the drawings are merely representative, are not necessarily drawn to scale, and are not intended to limit the subject matter of this application.

DETAILED DESCRIPTION

Before the present invention is described in greater detail, it is to be understood that this invention is not limited to a particular embodiment described, and as such may, of course, vary. It is also to be understood that the terminology used herein is to describing particular embodiments only, and is not intended to be limiting, since the scope of the present invention will be limited only by the appended claims.

Where a range of values are provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both limits, ranges excluding either or both of those included limits are also included in the invention.

Other than in the embodiment or example, or where indicated otherwise, all numbers indicating ingredient quantities and/or reaction conditions are to be understood as being modified in every instance by the word "about," which means the ingredient quantities or reaction conditions are within 10 percent to 15 percent of the indicated value.

Unless defined otherwise, all terms used herein have the same meaning as commonly understood by one of ordinary skill in the art to which this invention belongs. Although any methods and materials similar or equivalent to those described herein can be used in the practice or testing of the present invention, some potential and exemplary methods and materials may now be described.

It must be noted that as used herein and in the appended claims, the singular forms "a", "an", and "the" may also include the plural referents unless the context clearly dictates otherwise.

It is further noted that the claims may be drafted to exclude any element that may be optional. As such, this statement is intended to serve as antecedent basis for use of such exclusive terminology as "solely", "only" and the like in connection with the recitation of claim elements, or the use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention.

Figure 1:
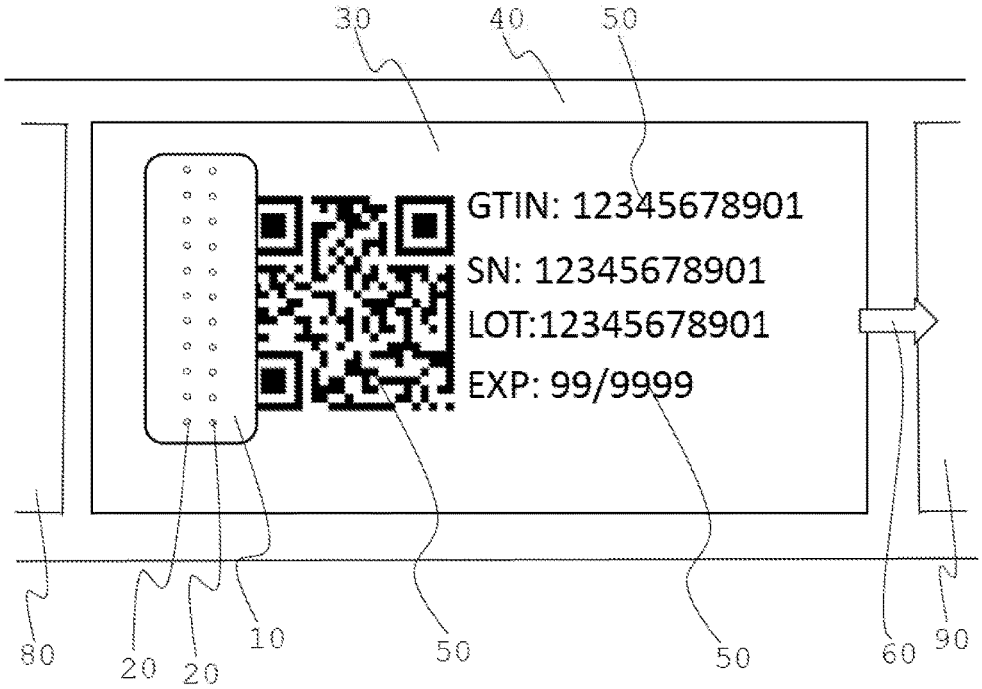
FIG. 1 Prior Art
FIG. 1 is a schematic view of a prior art of inkjet printer for product coding printing system.

Referring to FIG. 1, a prior art of an inkjet printer head 10 having rows of ink nozzles 20 arranged perpendicular to the travel direction 60 of a printing object 30 such as a web or a roll of label, with an already printed printing object 90 and a blank printing object 80, arranged on a production line 40. The inkjet printer head 10 is stationary. To print the coding information 50 on the printing object 30, a blank printing object 30 on the production line 40, such as a web of a roll of labels, has to move in the travel direction 60 for a determined length to be stopped under the inkjet printer head 10. After printing, the printing object 30 is moved in the travel direction, and the blank printing object 80 will be moved to under the inkjet printer head 10, which is called indexing.

Figure 2:
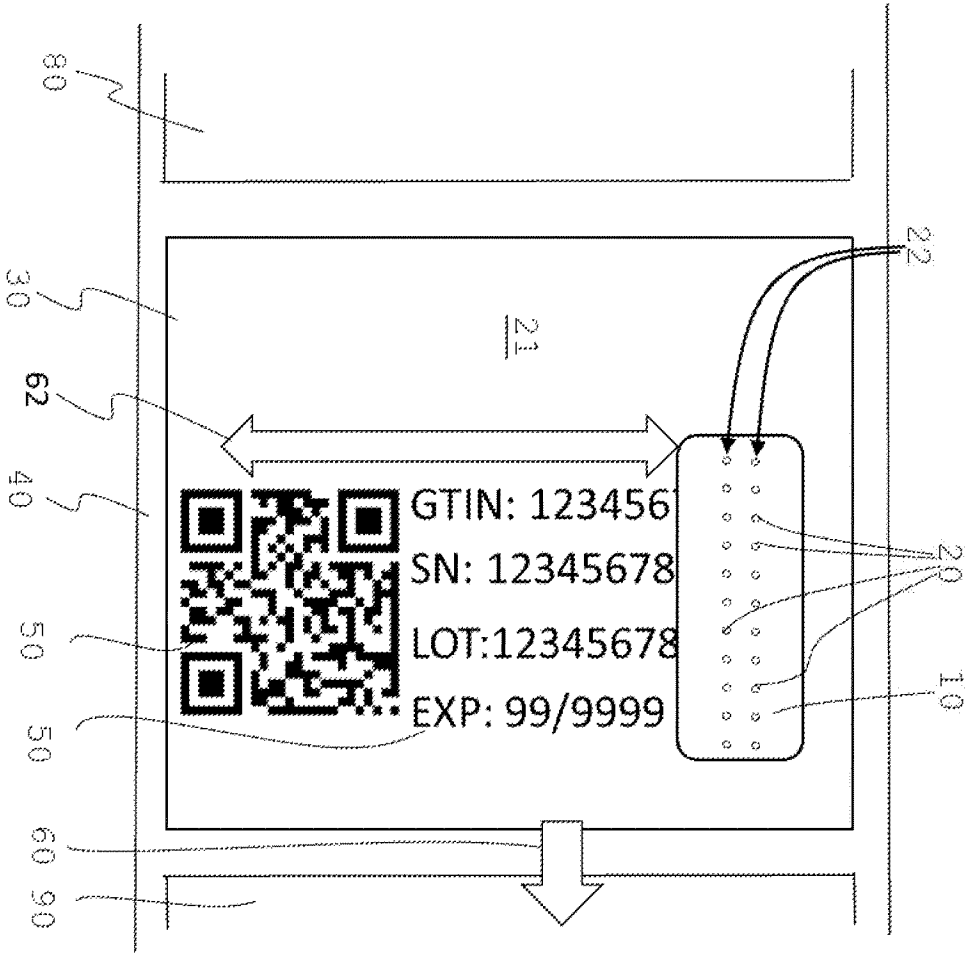
FIG. 2 is a schematic view of one embodiment of current invention showing the relative moving directions of the inkjet printer head and the printing object.

Referring to FIG. 2, one embodiment of the invention shows that of an inkjet printer head 10 having multiple rows of ink nozzles 20 arranged along or in a direction same as the travel direction 60 of a plurality of printing objects 30 such as a web of a roll of labels, with an already printed printing object 90 and a blank printing object 80, on a production line 40. The printing objects 80 has a printing surface 21 arranged vertically in a production line. The ink nozzles 20 face the printing surface 21 of the plurality of printing objects 30, wherein the plurality of ink nozzles 20 is arranged in a plurality of rows 22 configured along the travel direction 60 of the plurality of printing objects 30. The inkjet printer head 10 can move up and down vertically 62, wherein the inkjet printer head moves orthogonally to the travel direction of the plurality of printing objects when the inkjet printer head ejects an ink.

The inkjet printer head 10 can traverse across or move orthogonally to the travel direction 60 of the printing object 30. To print the coding information 50 on the printing object 30, the printing object needs to be remained unmoved under the inkjet printer head 10 when the inkjet printer head 10 is moving over the printing object 30, preferably, at a predetermined constant speed and printing the coding information 50 on the printing object 30. When completing of printing the coding information 50, the inkjet printer head moves to an initial position, and the printing object 30 is moved away the inkjet printer head 10 in the travel direction 60, and the blank printing object 80 will be indexed under the inkjet printer head 10 for next printing. It should be noted that the ink nozzles are not necessary arranged in a straight line or lined up in each row. They can be arranged to form a row direction in general. It is also noted that the communication means can be traditional wire, glass optical fiber, or wireless communication transmission.

Figure 3A:
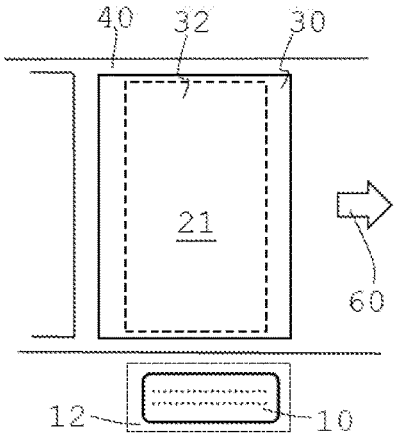
FIG. 3A is a schematic view of one embodiment of the printing sequences of the current invention.
Figure 3B:
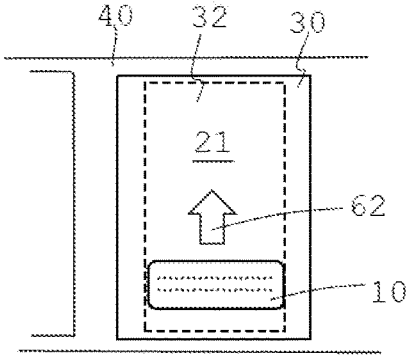
FIG. 3B is a schematic view of one embodiment of printing sequences of the current invention.
Figure 3C:
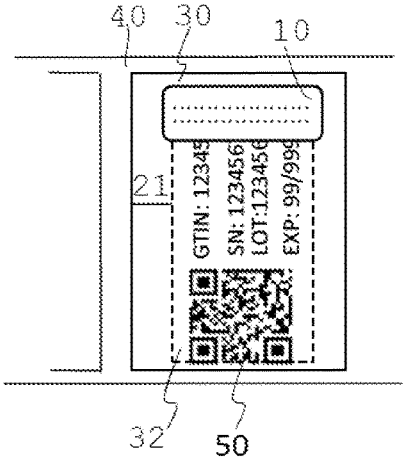
FIG. 3C is a schematic view of one embodiment of printing sequences of the current invention.
Figure 3D:
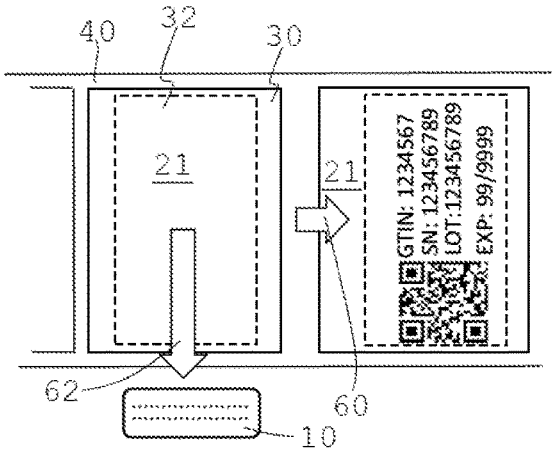
FIG. 3D is a schematic view of one embodiment of printing sequences of the current invention.

Referring to FIG. 3A, FIG. 3B, FIG. 3C, and FIG. 3D, one of the embodiments of the invention shows the steps of printing. The inkjet printer head 10 is in an initial position 12 waiting for the plurality of predetermined printing instructions and the printing object 30 is indexed to the inkjet printer head 10 for printing (FIG. 3A). Once a print trigger/command is received. the inkjet printer head 10 is first accelerated to a traversing speed and then maintain the constant speed on the traverse direction 62 when the inkjet printer head 10 is moved onto a printing area 32 (FIG. 3B). The inkjet printer head 10 is in a predetermined constant speed on a traverse direction 62 when the inkjet printer head 10 is traversing across the printing area 32 and printing (FIG. 3C). The inkjet printer head 10 finishes the printing and is decelerated to move back to the initial position 12, at same time, next blank printing object 80 is indexed into inkjet printer head 10 for next printing process. Noted that the traverse direction 62 of the inkjet printer head 10 can be up and down and the initial position or end positions of the inkjet printer head 10 is not limited to the positions illustrated exemplarily in the figures. The system can also be configured to accelerate and print in one direction, pause, wait for the object/label to index, and once it received the print trigger/command it will accelerate and print in the opposite direction. This allows the printer to print in both directions, on the way up and on the way down. To achieve faster print cycle time.

Figure 4:
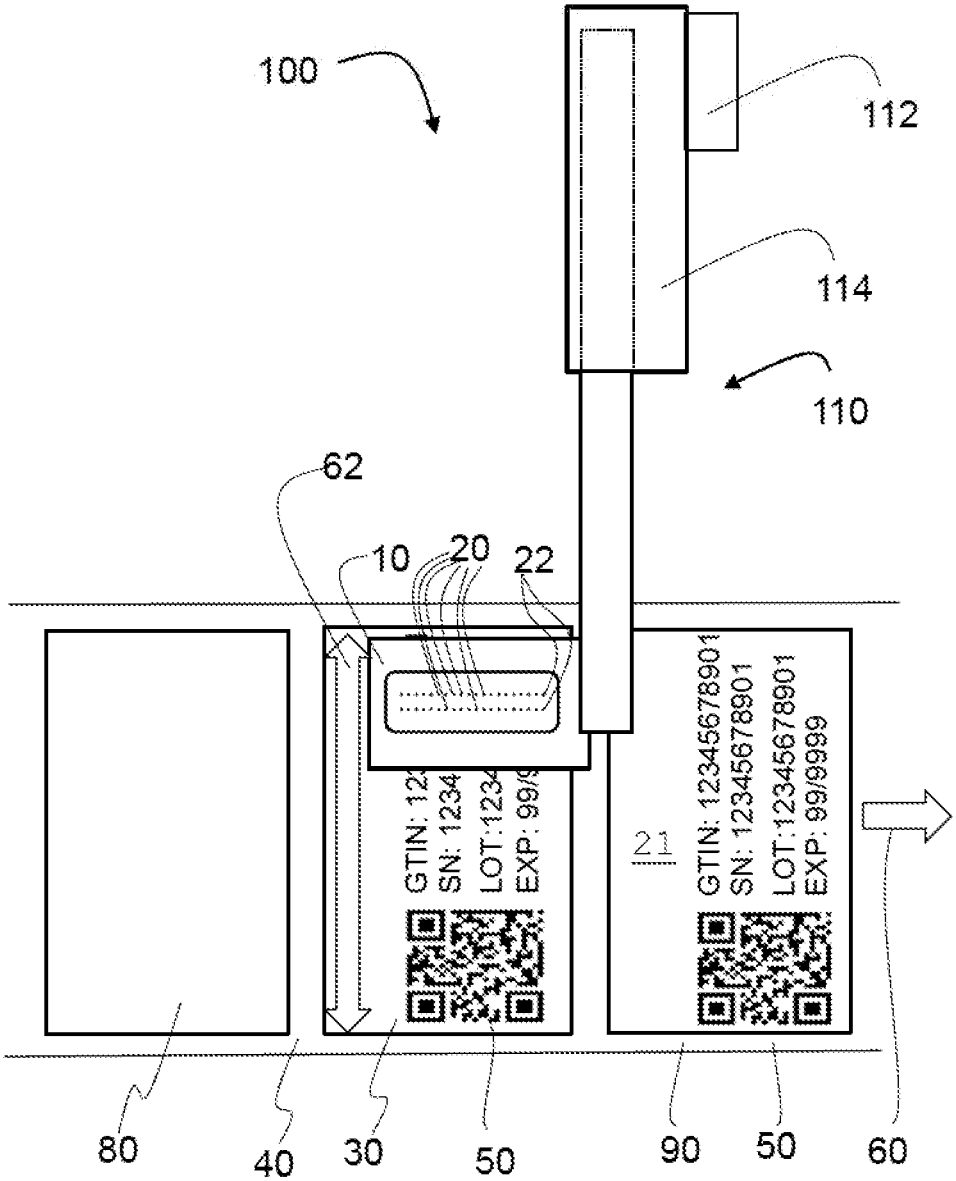
FIG. 4 is a schematic view of one embodiment of current invention.
Figure 5:
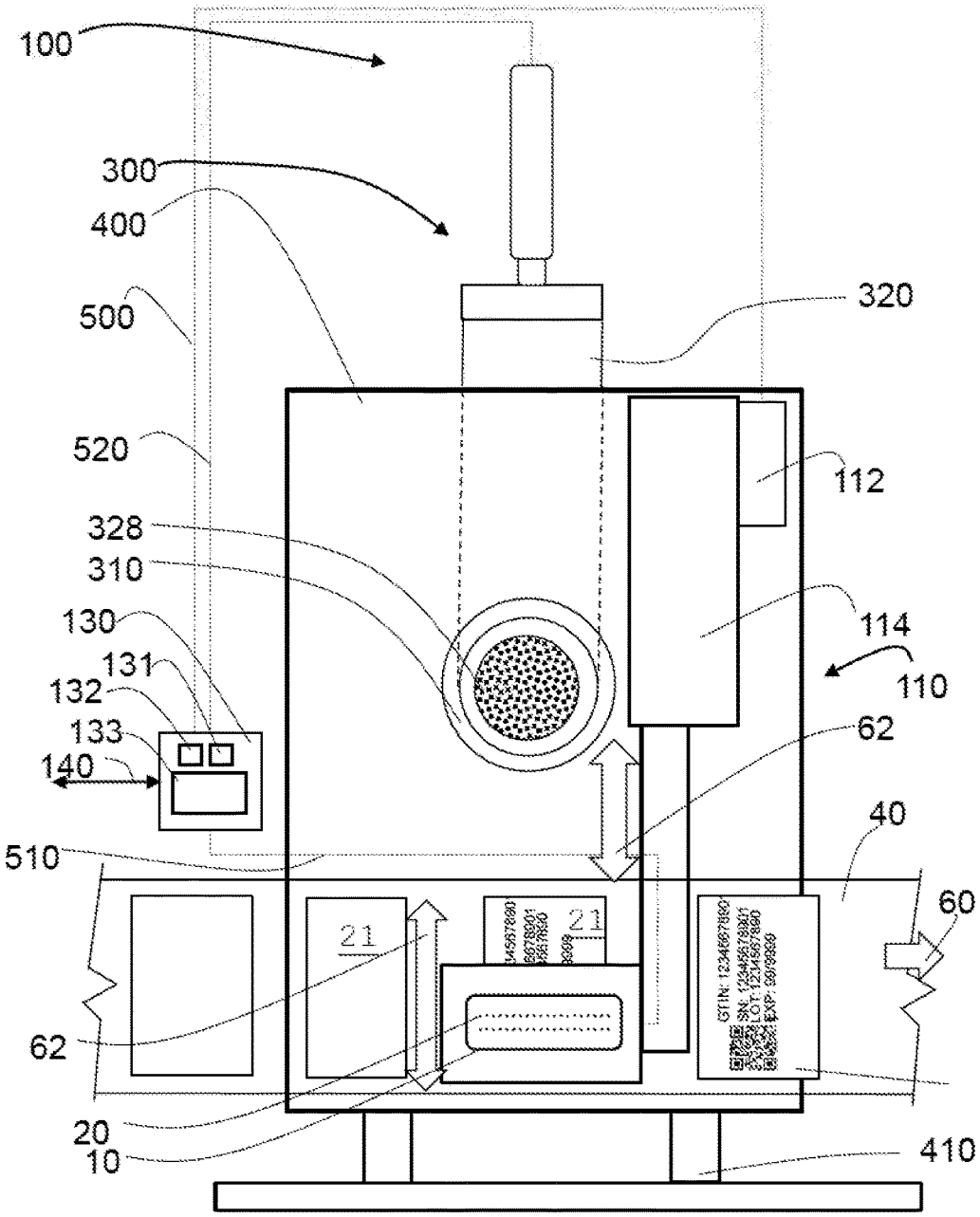
FIG. 5 is a front view of one embodiment of current invention.
Figure 6B:
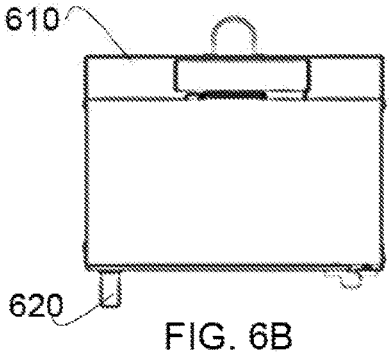
FIG. 6B is a top view of one embodiment of current invention.
Figure 6A:
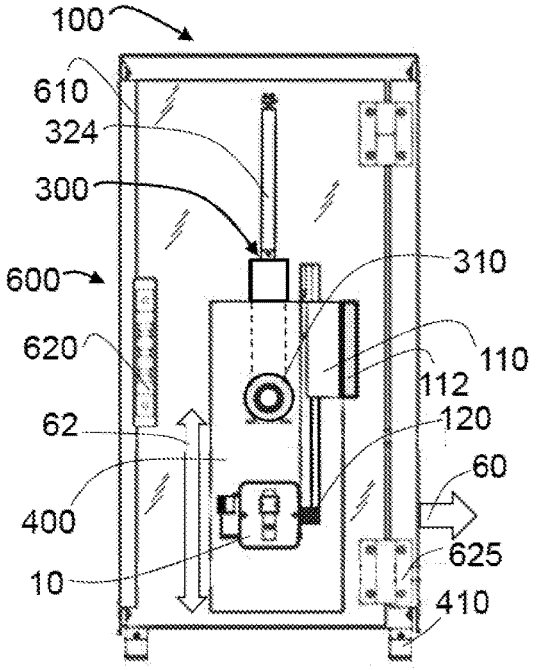
FIG. 6A is a front view of one embodiment of current invention.
Figure 6C:
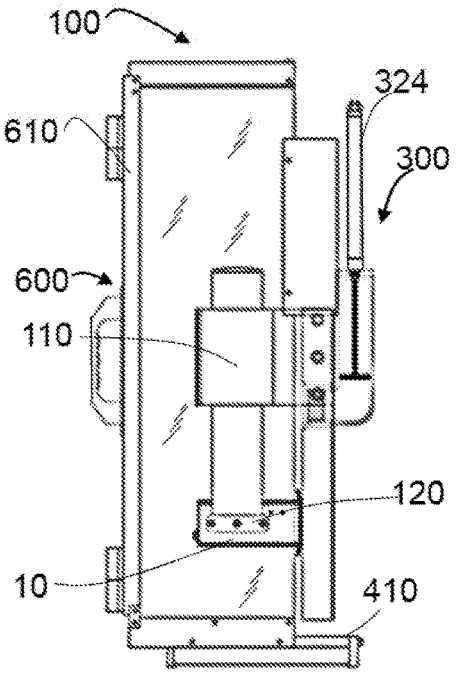
FIG. 6C is a side view of one embodiment of current invention.
Figure 7:
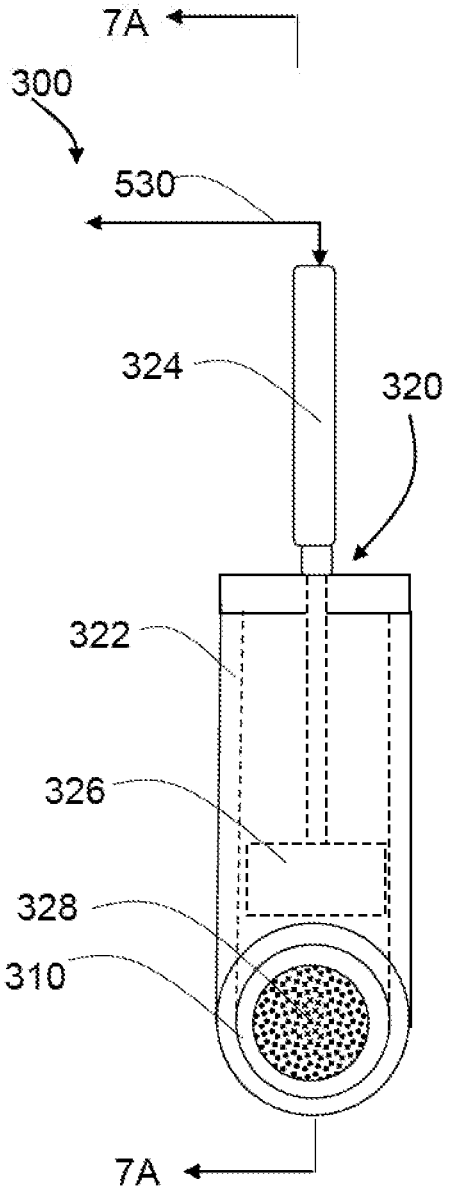
FIG. 7 is a frontal schematic view of one embodiment of the ink purge system of current invention.
Figure 7A:
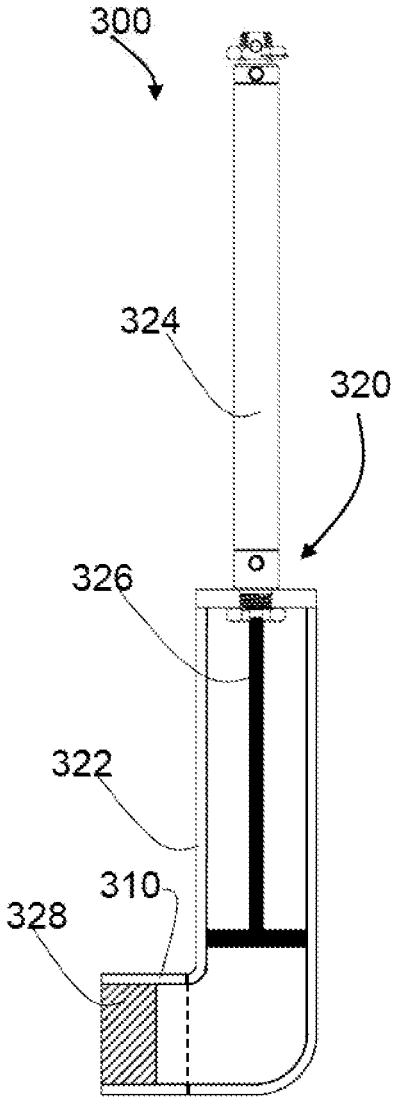
FIG. 7A is a side sectional view of one embodiment of the ink purge system of current invention.
Figure 8:
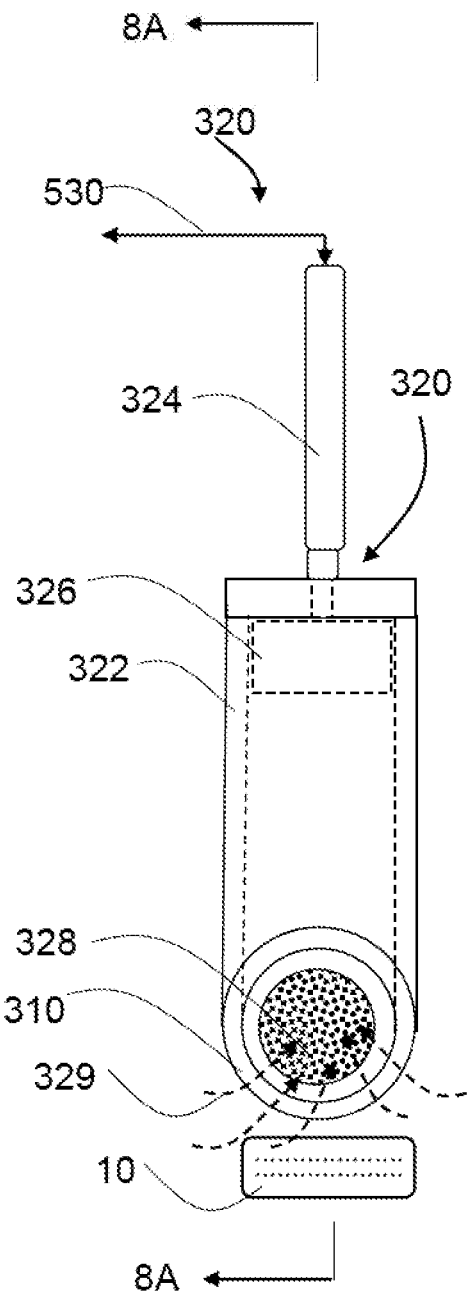
FIG. 8 is another frontal schematic view of one embodiment of the ink purge system of current invention.
Figure 8A:
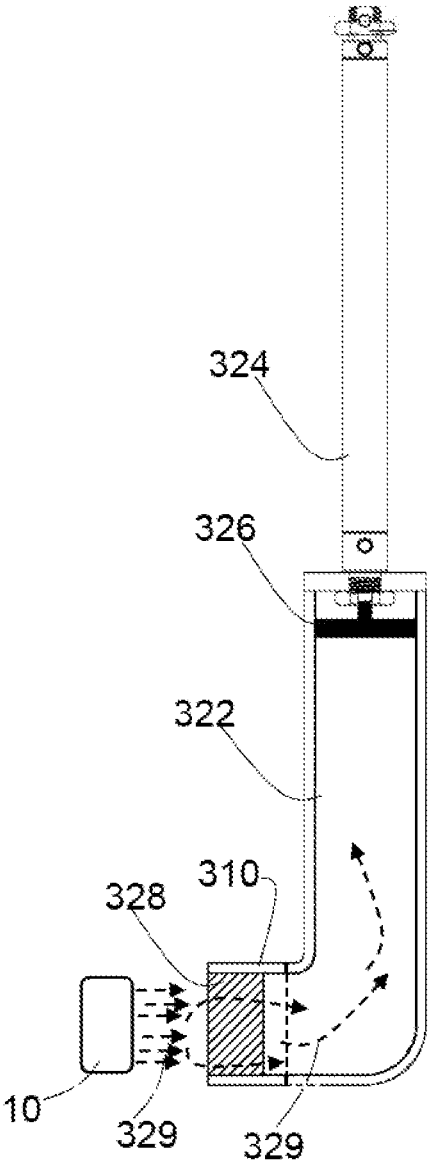
FIG. 8A is another sectional view of one embodiment of the ink purge system of current invention.
Figure 9:
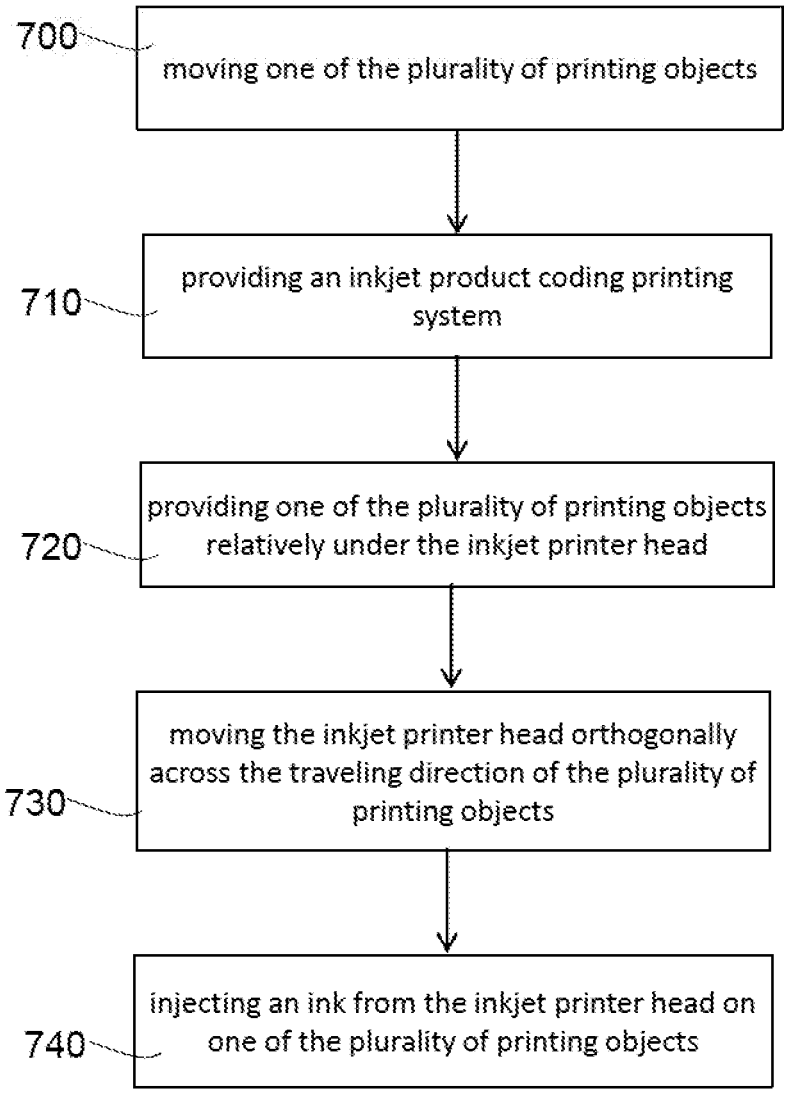
FIG. 9 is a process flow view of one embodiment of the method.
Figure 10:
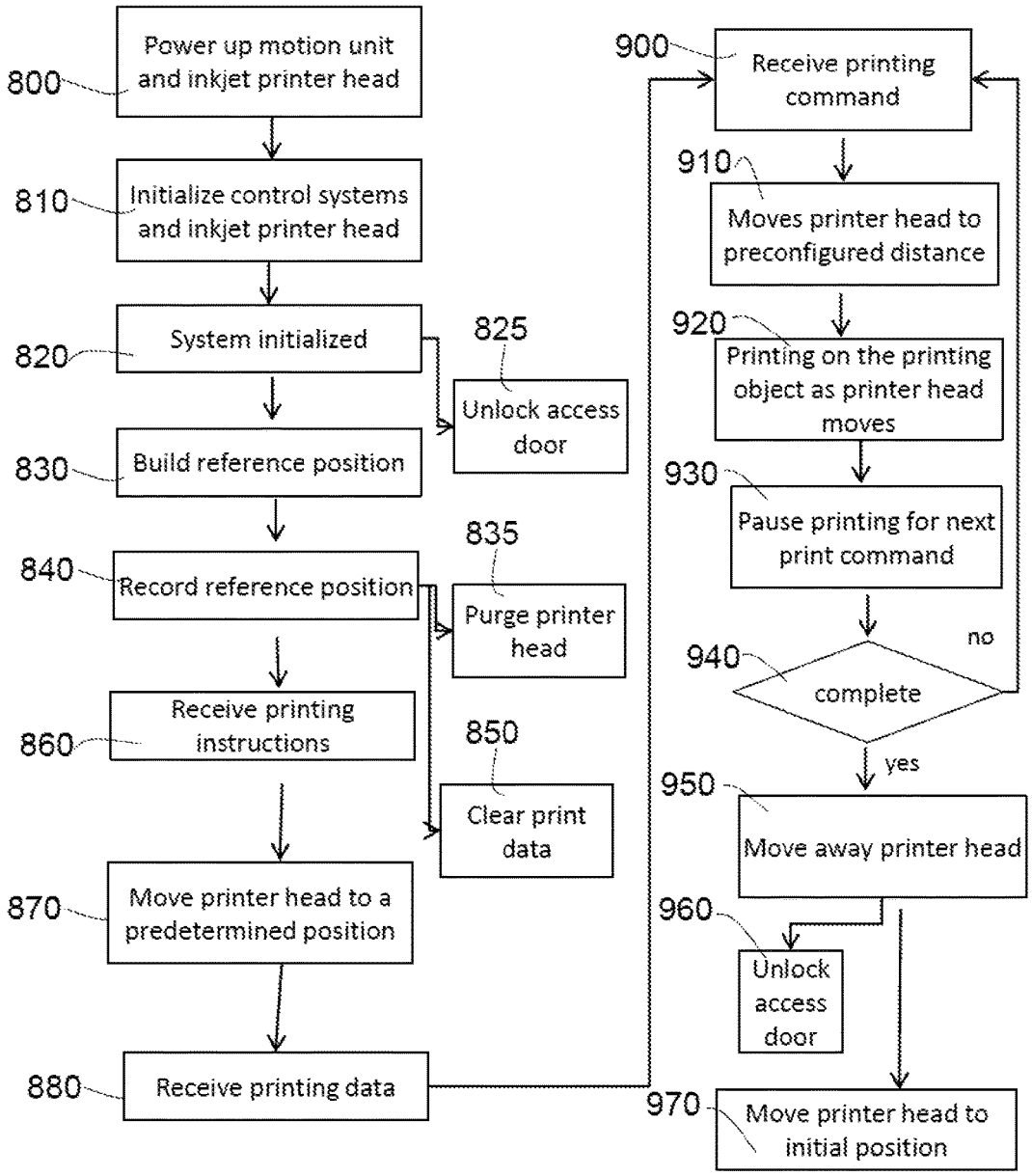
FIG. 10 is another process view of another embodiment of the method.

Referring to FIG. 4 and FIG. 5, one preferred embodiment of an inkjet product coding printing system 100 for a production line 40 comprises at least one inkjet printer head 10, wherein the inkjet printer head 10 further comprises a plurality of ink nozzles 20 arranged in a plurality of rows 22, at least one motion unit 110 connected with the inkjet print head 10 or optionally one traverse frame 120 connecting the at least one motion unit 110 and the at least one inkjet printer head 10; and at least one control system 130 controlling the motion control unit 112 through a first communication mean 500, controlling the inkjet printer head 10 through second communication mean 510, and the ink purge system 300 through third communication mean 520, wherein the inkjet printer head 10 traverses across or moves orthogonally across the travel direction 60 of the plurality of printing objects 30 on the production line 40, wherein the a plurality of rows 22 of ink nozzle 20 is across the travel direction 60 of the production line 40. The motion unit can be any motor system with moving structure capable of traveling back and forth in a linear way. In one preferred embodiment, the motion unit comprises a weight-compensation linear motor 114 or similar motor devices that can provide linear motions with a balance to counter the weight of the inkjet printer head and its accessories. The weight-compensation linear motor is known to the person having an ordinary skill in the art of motors. The weight-compensation linear motor may have magnetic spring, mechanical spring, pneumatic spring, hydraulic spring, or other suspension system to counter the weight of objects or the gravity force of the objects when the object attached to the linear motor is moved vertically by the linear motor. Without the weight-compensation, the linear motor must always be powered or be braked to hold the object attached with the linear motor so that it prevents the gravity force of the object to pull down the object. With the weight-compensation linear motor, it does not have to continuously hold or brake on the object attached to the linear motor. As a result, the object is in a zero-gravity-like status, which allows the linear motor to move the object more freely, dynamically, and accurately to stop at a position. In current market, there are many weight-compensation linear motors or weight-compensation device used with linear motors, such as but not limited LINAX® of Jenny Science AG®, MagSrping® of LinMot®, MLZ® of SINA-DRIVES®, Gantry Systems® of HIWIN®.

Also, referring to FIG. 5, in one embodiment, the inkjet product coding printing system 100 further comprises an interface 140 with other machines. The interface 140 can be communicated via hard I/O or via a communication protocol like TCP/IP. This allows the system to integrate easily with other machines with any additional custom code. Also, referring to FIG. 5, the motion unit 110 has motion control unit 112.

Also, referring to FIG. 5, FIG. 6A, FIG. 6B, and FIG. 6C, in one embodiment, the inkjet product coding printing system 100 further comprises a supporting frame 400, wherein the motion unit 110 is fastened onto the supporting frame 400, and wherein the supporting frame 400 is fastened on a supporting base 410.

Referring to FIG. 5, FIG. 6A, FIG. 6B, FIG. 6C, FIG. 7A, and FIG. 7B, in one embodiment, the inkjet product coding printing system further comprises a safety guarding system 600, wherein safety guarding system 600 further comprises at least an shelter 610 enclosing the inkjet product coding printing system 100 inside the shelter 610, at least an access door 620 configured on an access opening formed on the shelter 610, at least one door sensor 630 (FIG. 7A), at least a shut-off switch 640 connecting the at least one door sensor with the inkjet product coding printing system 100. one control system 130 (FIG. 5) controlling the pneumatic device 320 through a fourth communication mean 530. The access door 620 can be hinged, mounted, or other fixation means 625 to the shelter 600. The shelter 600 can be made of any suitable material such as glass, plastic, acrylic, or metal, and in any suitable structure, but preferable transparent or see-through material or structure to see inside.

Also referring to FIG. 5, in one preferred embodiment, the inkjet product coding printing system 100, wherein the control system 130 further comprises a memory (non-transitory medium) 131 configured to store a plurality of instructions and a processor 132 configured to execute the plurality of instructions configured to control the inkjet product coding printing system, to select a speed of the motion unit to move the inkjet printer head or the speed to release ink from the inkjet printer head, to set up a plurality of fault situations and a plurality of alarms in response to the plurality of fault situations such as the unlocked access door or motor issues, to manage recipe that configures a plurality of parameters for a plurality of print distances in accordance with the size of the printing objects 30 or printing area 32 and the amount of coding information to be printed on the label or printing object, a plurality of print cycle speed, and an initial vertical position of the inkjet printer head. The print distances may include the distance of the inkjet printer head 10 to move up and down within the printing area 32. The control system 130 may also comprises a user interface 133 to display and receive a plurality of inputs to communicate with the control system 130. The control system can control different speed of the inkjet product coding printing system 100 for different print cycle on demand. The recipe management system can retain and store a sets of recipes, which is a combination of different parameters like print distances, print cycle speed per each direction, and different initial start position vertically based on the customer preference. This allows for easy of changeover and setup between different products. The costumed humane user interface 133 allows to complete control of all the different devices; manage recipe; select an inkjet printer head speed and/or the motion unit speed from a list of predetermined constant speed for speed of ink released from inkjet printer head and/or the speed of the movement of the inkjet printer head, manage alarms and fault conditions transmitted from the communication means 500, 510, and 520, configure different parameters, like print distance and initial print position in vertical direction, and provide other options to ease the control and interface with all the different devices and other controls in the product lines from one central location. Each print cycle may comprise the movement of the inkjet printer head to move up, move down, stop in a predetermined consequence defined by the parameters in a recipe.

Referring to FIG. 5, FIG. 7, FIG. 7A, FIG. 8, and FIG. 8A, one embodiment of the inkjet product coding printing system 100 for a production line further comprises an ink purge system 300, wherein the ink purge system 300 further comprises a housing 310, a vacuum system 320 to provide a negative pressure (relatively to the ambient air pressure) in the housing 310, and optionally an ink contact 328 disposed in the housing 310. In one preferred embodiment, the vacuum system 320 further comprises and one cylinder 322 and one pneumatic device 324 having one piston 326 extending inside the cylinder 322. The housing 310 is connected and communicates with the cylinder 322. The cylinder 322 becomes a vacuum environment (a relatively lowered pressured environment than the ambient air pressure) when the piston 326 of the pneumatic device 324 is retracted from first end of the cylinder 322 located close to the housing 310 to second end of the cylinder 322 located near the pneumatic device 324. The air with ink droplet mix 329 around a purge area will be moved into cylinder 322. In another embodiment, the vacuum means may be any means by connecting the housing 310 to a vacuum pump (not shown), a pneumatic device 324, or a vacuum piping system (not shown). In one embodiment, the ink purge system 300 comprises at least one ink contact 328 comprising materials such as but not limited to an absorbing pad, a sponge, a paper towel, or a fabric, allowing ink to be blotted or absorbed on the ink contact. The ink purge system 300 is located away from the print area so that it wouldn't impede the traverse of the inkjet printer head 10, and allows for the largest possible print area. This purging process in the printer is basically a command where the printer sprays ink from the ink nozzles to clear blockages. The vacuum system will be in sync with the purge command to capture the ink and eliminate any potential ink buildup around the machine. The benefit of this inventive ink purge system is that this ink purge system may not have to use any vacuum source that is connected or discharges to other places. Therefore, air with ink droplet mix 329 will not be discharged or transmitted to another place. Instead, the air and ink droplet will be retained in the cylinder 322 of ink purge system 300 or the ink contact 328. Thus, it will not contaminate the production line or the manufacturing facility or amenity, and keep them clean.

Referring to FIGS. 3, 4, 5, and 9, in one preferred embodiment of the invention, a method of printing product coding information on a plurality of printing objects 30, comprises moving one of the plurality of printing objects 30 in a travel direction 60 (Step 700); providing an inkjet product coding printing system 100 (Step 710), where the inkjet product coding printing system 100 further comprises at least one inkjet printer head 10, wherein the inkjet printer head 10 further comprises a plurality of ink nozzles 20 arranged in a plurality of rows 22, wherein the plurality of rows 22 has a row direction configured along the travel direction 60 of the plurality of printing objects 30; a motion unit 110, wherein the inkjet printer head 10 is mounted to the motion unit 110, and one control system 130 controlling the motion unit 110 and the inkjet printer head 10; providing one of the plurality of printing objects 30 relatively under the inkjet printer head 10 (Step 720); moving the inkjet printer head 10 orthogonally across the traveling direction 60 of the plurality of printing objects 30 (Step 730); and injecting an ink from the inkjet printer head 10 on one of the plurality of printing objects 30 at a same time as moving the inkjet printer head 10 (Step 740).

Referring to FIGS. 3, 4, 5, 6A, 6B, 6C, and 10, another embodiment of the invention further comprises the steps of powering up the inkjet printer head 10 and the motion unit 110 (Step 800); initializing the at least one control system 130 (Step 810); initializing all systems (Step 820); optionally checking the access door 620 of safety guarding system and locking the access door 620 if not unlocked (Step 825); building a reference position of the inkjet printer head (Step 830); recording the reference position in the one control system (Step 840); optionally purging the inkjet printer head when it is necessary to clear up any blockage or do maintenance (Step 835); optionally clearing data if there is same saved data from previous printing (Step 850); receiving a plurality of predetermined printing instructions or so-called receipt (Step 860); moving the inkjet printer head to a printing position in accordance with the plurality of predetermined printing instructions (Step 870); receiving a set of printing data comprising a set of product coding data (Step 880); receiving printing command by the control system (Step 900); moving the inkjet printer head for a preconfigured distance in printing instructions (Step 910); printing on one of the plurality of printing objects as inkjet printer head moves orthogonally across the travel direction of the plurality of printing objects (Step 920); and pausing the printing for the print command until completing the printing instructions (Step 930); receiving printing command in Step 900 if the printing is not complete (Step 940); moving the inkjet printer head away preferably to the furthest opposition away the printing objects (Step 950); optionally unlocking the access door 620 if the printing is complete (Step 960); and moving the inkjet printer head to a predetermined initial position and waiting (Step 970).

As described above, the embodiments of the invention can solve the issue of low printing quality due to inconstant traveling speed of the label or printing object. They also solve the issue of slow printing. Instead of trying to move the label or printing object in a higher speed or trying to stabilize the traveling speed of printing object, the embodiments of the invention inventively and innovatively moves the inkjet printer head to print while the label or printing object remains unmoved. There is no precedent that the inkjet printer in production line has ever tried that. It is also a novelty that the inkjet printer head of the inkjet of current invention is turned 90 degrees so that the rows of ink nozzle are along or in a direction same as the travel direction of the label web or printing object line. The inkjet printer is driven by a motion unit with the capability to accelerate the inkjet printer to a predetermined constant speed in a short time.

It is understood that the embodiments of the invention and its constituent parts described herein is an exemplary indication of a preferred embodiment of the invention, and is given by way of illustration only. In other words, the concept of the present invention may be readily applied to a variety of preferred embodiments, including those disclosed herein. While the invention has been described in detail and with reference to specific examples thereof, it will be apparent to one skilled in the art that various changes and modifications can be made therein without departing from the spirit and scope thereof.

What claimed is:

1. An inkjet product coding printing system comprising:

(a) a plurality of printing objects, wherein the plurality of printing objects further comprises a travel direction, wherein the plurality of printing objects further comprises a printing surface arranged vertically;

(b) at least one inkjet printer head, wherein the inkjet printer head further comprises a plurality of ink nozzles facing the printing surface of the plurality of printing objects, wherein the plurality of ink nozzles is arranged in a plurality of rows configured along the travel direction of the plurality of printing objects, wherein the inkjet printer head can move up and down vertically, wherein the inkjet printer head moves orthogonally to the travel direction of the plurality of printing objects when the inkjet printer head ejects an ink;

(c) a motion unit connected with the inkjet printer head; and (d) at least one control system controlling the motion unit and the inkjet printer head;

(e) wherein the motion unit further comprises a supporting frame and a weight-compensation linear motor, wherein the motion unit is fastened on the supporting frame.

2. The inkjet product coding printing system of claim 1, wherein the motion unit moves at a predetermined constant speed when the inkjet printer head injects the ink.

3. The inkjet product coding printing system of claim 1, further comprising an ink purge system, wherein the ink purge system further comprises a housing and a vacuum means to provide a negative pressure to absorb the ink into the housing.

4. The inkjet product coding printing system of claim 3, further comprising a cylinder communicated with the housing; a piston inside the cylinder; and a pneumatic device connected with the piston, wherein the pneumatic device retracts the piston from a first end of the cylinder to a second end of the cylinder to cause a vacuum environment in the housing and suck the ink into the cylinder.

5. The inkjet product coding printing system of claim 3, wherein the ink purge system further comprises an ink contact disposed in the housing.

6. The inkjet product coding printing system of claim 1, further comprising a safety guarding system; wherein the safety guarding system further comprises at least a shelter enclosing the inkjet printer head and the motion unit inside the shelter, at least an access opening formed on the shelter, at least an access door configured on the access opening, at least one door sensor, and at least a shut-off switch communicating with the at least one door sensor with the inkjet product coding printing system.

7. The inkjet product coding printing system of claim 1, wherein the inkjet product coding printing system is configured to communicated with a production line through the at least one control system.

8. The inkjet product coding printing system of claim 1, wherein the at least one control system further comprises a memory configured to store a plurality of instructions and a processor configured to execute the plurality of instructions configured to control the inkjet product coding printing system, to select a speed of the motion unit, to set up a plurality of fault situations and a plurality of alarms in response to the plurality of fault situations, to manage recipe that configures a plurality of parameters for a plurality of print distances, a plurality of print cycle speed, and an initial vertical position of the inkjet printer head.

9. The inkjet product coding printing system of claim 8, further comprising a user interface to display and receive a plurality of inputs to communicate with the control system.

10. An inkjet product coding printing system comprising:

(a) a plurality of printing objects, wherein the plurality of printing objects further comprises a travel direction, wherein the plurality of printing objects further comprises a printing surface arranged vertically;

(b) at least one inkjet printer head, wherein the inkjet printer head further comprises a plurality of ink nozzles facing the printing surface of the plurality of printing objects, wherein the plurality of ink nozzles is arranged in a plurality of rows configured along the travel direction of the plurality of printing objects, wherein the inkjet printer head can move up and down vertically, wherein the inkjet printer head moves orthogonally to the travel direction of the plurality of printing objects when the inkjet printer head ejects an ink;

(c) a motion unit connected with the inkjet printer head, wherein the motion unit further comprises a supporting frame and a weight-compensation linear motor, wherein the motion unit is fastened on the supporting frame, wherein the motion unit moves at a predetermined constant speed when the inkjet printer head injects the ink;

(d) an ink purge system, wherein the ink purge system further comprises a housing and a vacuum means to provide a negative pressure to absorb the ink into the housing;

(e) a safety guarding system; wherein the safety guarding system further comprises at least a shelter enclosing the inkjet printer head and the motion unit inside the shelter, at least an access opening formed on the shelter, at least an access door configured on the access opening, at least one door sensor, and at least a shut-off switch communicating with the at least one door sensor with the inkjet product coding printing system;

(f) at least one control system controlling the motion unit and the inkjet printer head, wherein the control system further comprises a memory configured to store a plurality of instructions and a processor configured to execute the plurality of instructions configured to control the inkjet product coding printing system, to select a speed of the motion unit, to set up a plurality of fault situations and a plurality of alarms in response to the plurality of fault situations, to manage recipe that configures a plurality of parameters for a plurality of print distances, a plurality of print cycle speed, and an initial vertical position of the inkjet printer head; and (g) a user interface to display and receive a plurality of inputs to communicate with the control system.

11. A method of printing product coding information on a plurality of printing objects, comprising:

(a) moving one of the plurality of printing objects with a vertically arranged printing surface in a travel direction;

(b) providing an inkjet product coding printing system, where the inkjet product coding printing system further comprises at least one inkjet printer head, wherein the inkjet printer head further comprises a plurality of ink nozzles facing the printing surface of the plurality of printing objects, wherein the plurality of ink nozzles is arranged in a plurality of rows configured along the travel direction of the plurality of printing objects, wherein the inkjet printer head can move up and down vertically; a motion unit connected with the inkjet printer head; and at least one control system controlling the motion unit and the inkjet printer head; wherein the motion unit further comprises a supporting frame and a weight-compensation linear motor, wherein the motion unit is fastened on the supporting frame;

(c) providing one of the plurality of printing objects relatively under the inkjet printer head;

(d) moving the inkjet printer head orthogonally across the traveling direction of the plurality of printing objects; and (e) injecting an ink from the inkjet printer head on one of the plurality of printing objects at a same time as moving the inkjet printer head.

12. The method of claim 11, wherein the motion unit further comprises a weight-compensation linear motor and wherein the motion unit moves at a predetermined constant speed when the inkjet printer head injects the ink.

13. The method of claim 11, further comprising an ink purge system, wherein the ink purge system further comprises a housing and a vacuum means to provide a negative pressure to absorb the ink into the housing.

14. The method of claim 13, further comprising a cylinder communicated with the housing; a piston inside the cylinder; and a pneumatic device connected with the piston, wherein the pneumatic device retracts the piston from a first end of the cylinder to a second end of the cylinder to cause a vacuum environment in the housing and suck the ink into the cylinder.

15. The method of claim 13, wherein the ink purge system further comprises an ink contact disposed in the housing.

16. The method of claim 11, further comprising:

powering up the at least one inkjet printer head and the motion unit;

initializing the at least one control system;

building a reference position of the inkjet printer head;

recording the reference position in the one control system;

optionally purging the inkjet printer head;

optionally clearing data;

receiving a plurality of predetermined printing instructions by the control system;

moving the inkjet printer head to a printing position in accordance with the plurality of predetermined printing instructions;

receiving a set of printing data comprising a set of product coding data;

receiving a printing command by the control system;

moving the inkjet printer head for a preconfigured distance in the plurality of predetermined printing instructions;

printing on one of the plurality of printing objects as inkjet printer head moves orthogonally across the travel direction of the plurality of printing objects;

pausing the printing for the printing command until completing the plurality of predetermined printing instructions; and moving the inkjet printer head away.

17. The method of claim 11, further comprising:

providing a safety guarding system, wherein the safety guarding system further comprises at least a shelter enclosing the inkjet product coding printing system inside the shelter, at least an access opening formed on the shelter, at least an access door configured on the access opening, at least one door sensor, and at least a shut-off switch communicating with the at least one door sensor with the inkjet product coding printing system;

locking the access door after initializing the inkjet product coding printing system; and unlocking the access door after completing the printing.

* * * * *